US009181732B2

(12) United States Patent
Bland

(10) Patent No.: US 9,181,732 B2
(45) Date of Patent: Nov. 10, 2015

(54) LATCH RELEASE SYSTEM

(75) Inventor: Tim Bland, Worcestershire (GB)

(73) Assignee: HUF HULSBECK & FURST GMBH & CO. KG, Velbert (DE)

( * ) Notice: Subject to any disclaimer, the term of this patent is extended or adjusted under 35 U.S.C. 154(b) by 358 days.

(21) Appl. No.: 13/120,257

(22) PCT Filed: Oct. 9, 2009

(86) PCT No.: PCT/EP2009/063217
§ 371 (c)(1),
(2), (4) Date: Apr. 11, 2011

(87) PCT Pub. No.: WO2010/043573
PCT Pub. Date: Apr. 22, 2010

(65) Prior Publication Data

US 2011/0181058 A1 Jul. 28, 2011

(30) Foreign Application Priority Data

Oct. 13, 2008 (GB) ..... 0818637.1

(51) Int. Cl.

| | |
|---|---|
| ***E05B 3/00*** | (2006.01) |
| ***E05B 77/12*** | (2014.01) |
| ***E05B 77/06*** | (2014.01) |
| ***E05B 77/42*** | (2014.01) |
| *E05C 17/56* | (2006.01) |
| *E05B 85/10* | (2014.01) |

(52) U.S. Cl.
CPC ..... *E05B 77/12* (2013.01); *E05B 77/06* (2013.01); *E05B 77/42* (2013.01); *E05B 85/10* (2013.01); *Y10T 292/03* (2015.04); *Y10T 292/11* (2015.04); *Y10T 292/57* (2015.04)

(58) Field of Classification Search
CPC ..... E05B 77/06
USPC ..... 292/336.3, 251.5, DIG. 22
See application file for complete search history.

(56) References Cited

U.S. PATENT DOCUMENTS 3,719,248 A * 3/1973 Breitschwerdt et al. ..... 180/271
5,669,642 A * 9/1997 Kang ..... 292/336.3
6,007,122 A * 12/1999 Linder et al. ..... 292/336.3

(Continued)

FOREIGN PATENT DOCUMENTS

DE 197 56 344 A1 6/1999
DE 199 10 328 A1 9/2000

(Continued)

OTHER PUBLICATIONS

Examination Report from co-pending European Patent Application No. 09753054.7, (4 pages).
Translation of (Doc AL) European Patent No. 102005043989 published on Mar. 22, 2007.

*Primary Examiner* — Carlos Lugo
(74) *Attorney, Agent, or Firm* — Leydig, Voit & Mayer, Ltd.

(57) ABSTRACT

A latch release system for releasing a latch, the system having a rest position and an actuated position and requiring a first force to move the system from the rest position to the actuated position, the system including an inertia event sensor and a means for increasing the force required to operate system, wherein when the inertia event sensor detects an inertia event it activates said means so the system requires a second force, greater than the first force, to move the system to the actuated position.

16 Claims, 13 Drawing Sheets

(56) References Cited

U.S. PATENT DOCUMENTS

Figure 1A:
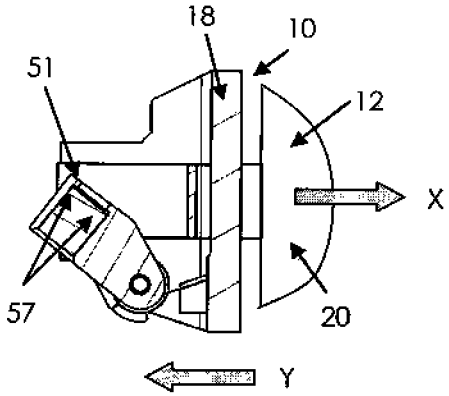

| | | | | |
|---|---|---|---|---|
| 6,042,159 | A * | 3/2000 | Spitzley et al. | 292/216 |
| 6,648,382 | B1 * | 11/2003 | Monig et al. | 292/336.3 |
| 6,712,409 | B2 * | 3/2004 | Monig | 292/336.3 |
| 7,097,212 | B2 * | 8/2006 | Willats et al. | 292/1 |
| 8,038,185 | B2 * | 10/2011 | Wood | 292/336.3 |
| 8,282,142 | B2 * | 10/2012 | Fannon | 292/336.3 |
| 8,322,077 | B2 * | 12/2012 | Papanikolaou et al. | 49/460 |
| 2002/0148075 | A1 * | 10/2002 | Monig | 16/412 |
| 2002/0167178 | A1 | 11/2002 | Spurr et al. | |
| 2003/0218340 | A1 | 11/2003 | Coleman et al. | |
| 2005/0184537 | A1 | 8/2005 | Le et al. | |
| 2008/0036219 | A1 | 2/2008 | Savant et al. | |

FOREIGN PATENT DOCUMENTS

| | | | | |
|---|---|---|---|---|
| DE | 102004008048 | A1 * | 9/2005 | E05B 65/42 |
| DE | 102005043989 | A1 | 3/2007 | |
| DE | 10 2007 007941 | A1 | 8/2008 | |
| DE | 102009038612 | A9 * | 6/2011 | |
| EP | 1 243 724 | A2 | 9/2002 | |
| EP | 2543801 | A2 * | 1/2013 | |
| FR | 2 867 216 | A1 | 9/2005 | |
| FR | 2882386 | A1 * | 8/2006 | E05B 65/12 |
| JP | 2007 040084 | A | 2/2007 | |

* cited by examiner

REST
LIMITED
SNAP PAST
FULL
RESET

LATCH RELEASE SYSTEM

The present invention relates to a latch release system for releasing a latch, in particular a latch for a land vehicle such as a car (automobile).

Cars include passenger doors which can be held in a closed position by a door latch. Operation of an outside door handle or an inside door handle will release the latch thereby allowing the door to be opened. Typically, the outside door handle is pivotally mounted on the associated door and by pulling on the outside handle an actuating system within the door operates to move either a Bowden cable or a rod. The Bowden cable or rod is connected to a door latch and movement on the Bowden cable or rod releases the door latch thereby allowing the door to be opened.

An inside handle is typically pivoted about a vertically orientated pivot.

An outside handle is typically pivoted about a vertically orientated pivot position towards the front of the handle. Alternatively an outside handle may be pivoted about a horizontally mounted pivot so that the handle moves outwards and upwards when pulled.

The handle possesses a mass and during a side impact on the vehicle the inertia of the handle can cause it to move in its opening direction relative to the door thereby allowing the door to open during the crash sequence. This is hazardous to occupants of the vehicle since the passenger safety cell of the vehicle relies on the door to remain closed during a crash.

It is known to use inertia blocking systems which are designed to prevent the handle moving to its open position during a crash however, such systems have disadvantages.

Thus U.S. 2008/0036219 shows a system where, in the event of a side impact the outside door handle is prevented from moving to its fully open position by a blocking arrangement. However, after the side impact has finished, and the vehicle has come to rest, the blocking system remains in place and it is not possible to release the latch using the door handle.

There is therefore a need to provide an improved system which prevents release of a latch during a crash, but which nevertheless allows the normal handle to be used to open the door following a crash.

Thus according to the present invention there is provided a latch release system for releasing a latch, the system having a rest position and an actuated position and requiring a first force to move the system from the rest position to the actuated position, the system including an inertia event sensor and a means for increasing the force required to operate system, wherein when the inertia event sensor detects an inertia event it activates said means so the system requires a second force, greater than the first force, to move the system to the actuated position.

Advantageously such a system never prevents an associated door handle from operating to release the latch. However the invention allows the second force to be set at a relatively high level, in particular a level higher than the highest envisaged opening force on that handle that will occur as a result of inertia during a crash. Putting it another way, latches are designed to withstand certain lateral G acceleration levels. Thus, the highest envisaged lateral G acceleration occurring might be, for example, 650 G. Such a 650 G acceleration might equate to inertia force on the door handle creating for example a 250N opening load. Clearly, under this envisaged situation the door must remain closed. The means for increasing the force required to open the latch might, by way of example, increase the opening force to 300N. As such the latch will remain engaged, but nevertheless the handle is never blocked from opening the latch since by applying a (manual) 300N load to the handle after the crash, i.e. once the vehicle has come to rest, the latch will always open.

Figure 21A:
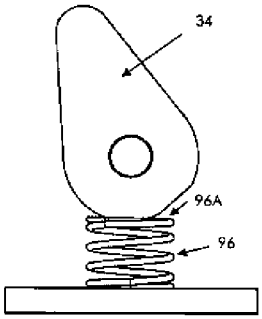
Figure 21B:
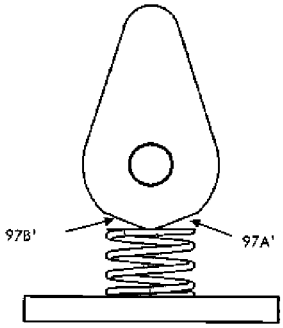
Figure 21C:
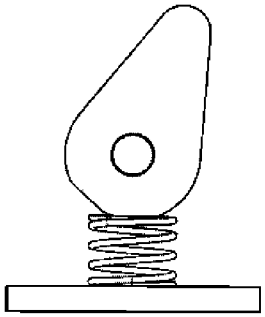
Figure 17:
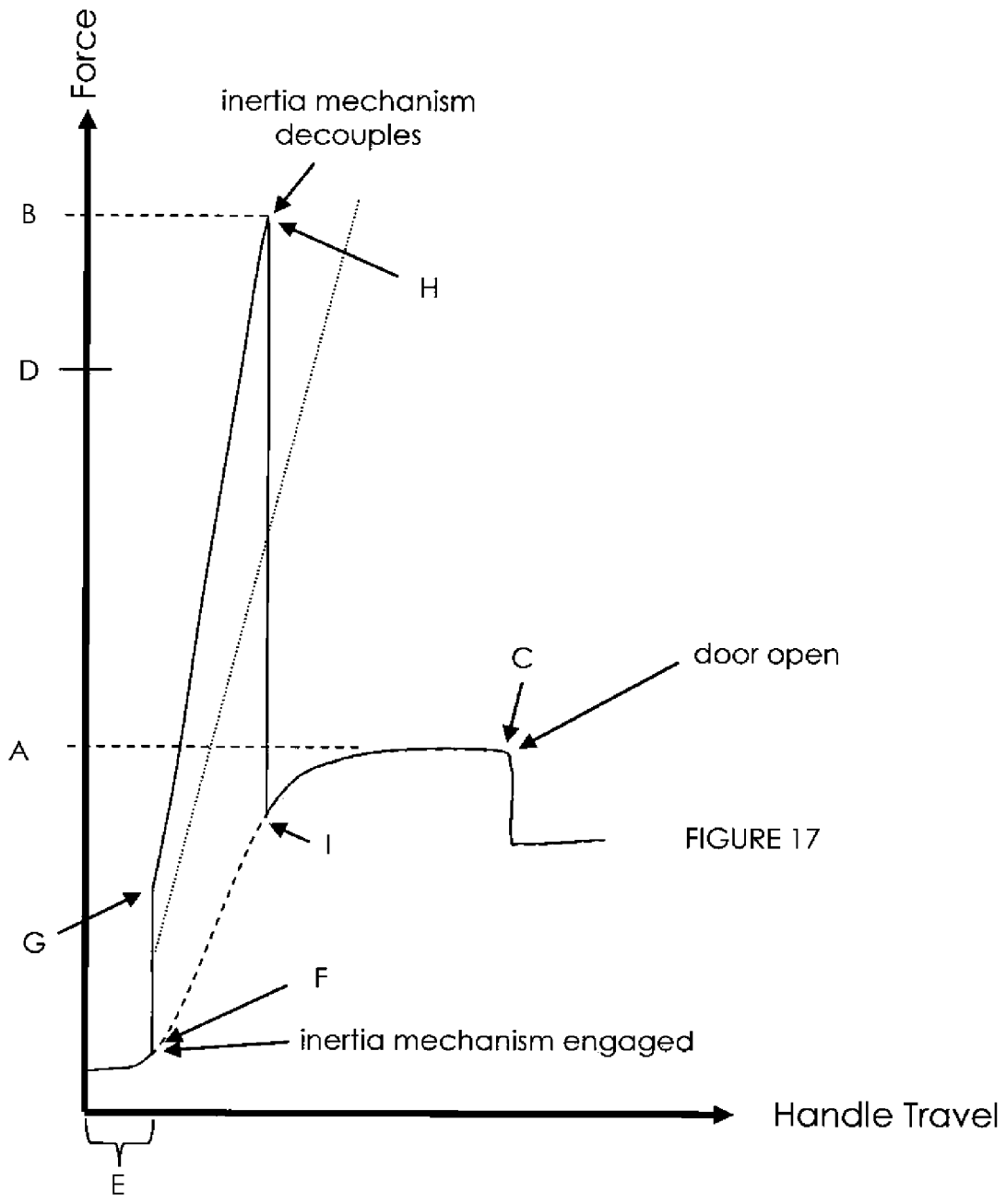
Figure 18:
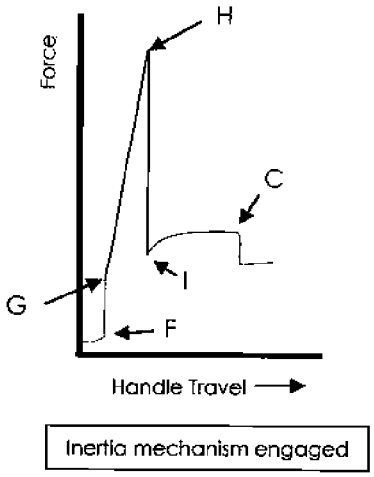
Figure 19:
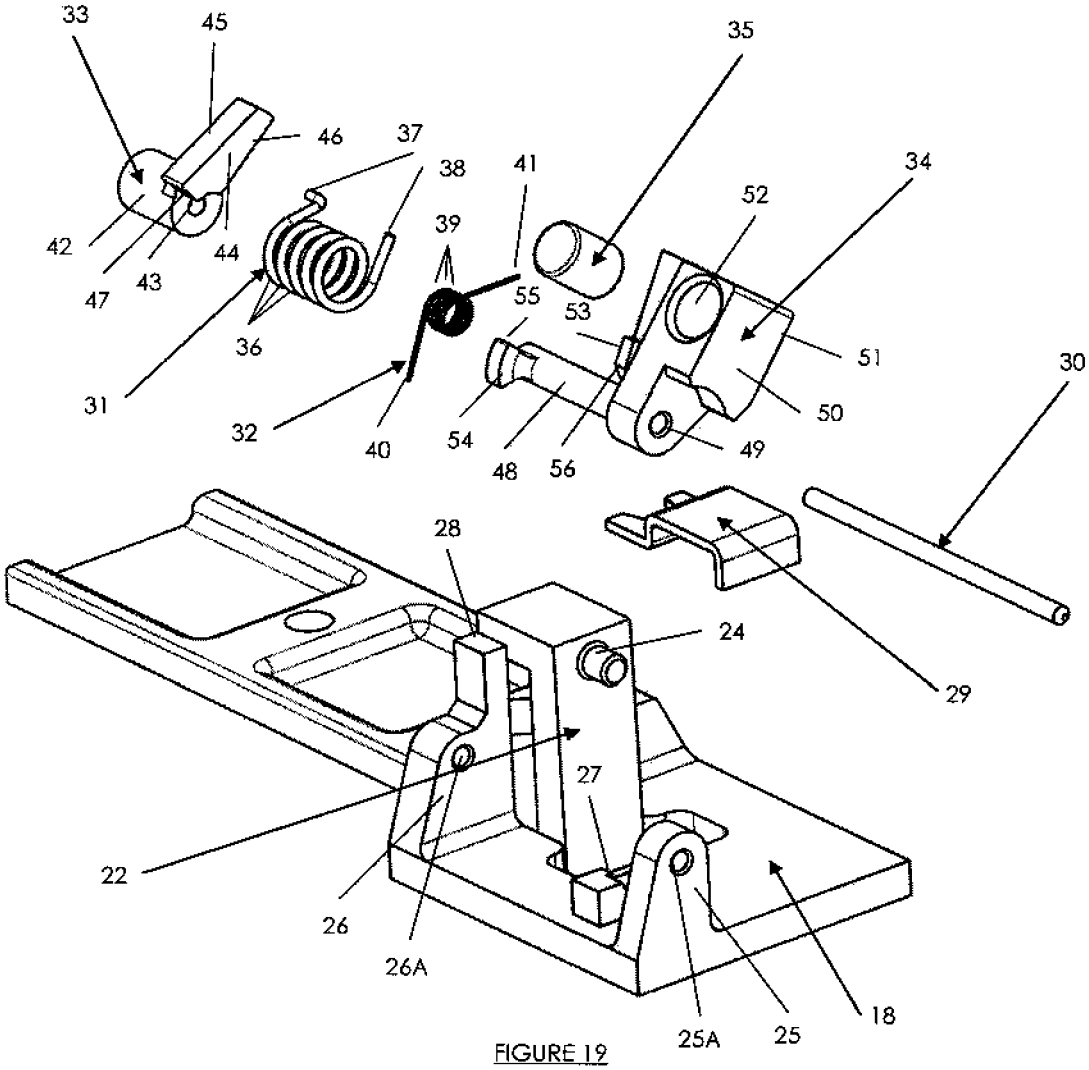

The invention will now be described, by way of example only with reference to the accompanying drawings in which:

FIGS. 1A to 8C shows various cross-sectional and isometric views of a first embodiment of a latch release system according to the present invention, FIGS. 9A to 9H shows operating sequences of the latch release system of FIG. 1A, FIGS. 10A to 14B shows various cross-sectional and isometric views of a second embodiment of a latch release system according to the present invention, FIGS. 15 to 18 shows various graphs, FIG. 19 shows an exploded view of FIG. 1C, FIG. 20A to 20C shows a variant latch release system according to the present invention, and FIG. 21A to 21C shows a further variant of a latch release system according to the present invention.

With reference to FIGS. 1A to 9H and FIG. 19 there is shown a latch release system in the form of a door handle assembly 10. The door handle assembly 10 is mounted on a door 11 (shown schematically and only shown in FIG. 3A).

The door handle assembly 10 includes a door handle 12 which includes a hand-operable portion 20 (shown schematically and only shown in FIG. 1A) connected to a handle strap 22. The handle strap 22 is connected by a transmission path 80 to a known latch 81 which is also mounted on the door 11.

Under normal circumstances, in order to open the door 11 a person will pull the hand-operable portion 20 in the direction of arrow X. This motion is transferred by the transmission path 80 to a pawl (not shown but well known in the art) within the latch. The movement disengages the pawl from a rotating claw (not shown but well known in the art) of the latch which in turn releases a striker (not shown but well known in the art) mounted on the door aperture. Once the claw has released the striker the door is free to open.

FIG. 19 shows the various components of the door handle assembly in more detail.

The handle strap 22 includes a pin 24. The door handle 12 is pivotally mounted to the handle chassis about a vertically orientated pivot (not shown). The handle chassis includes lugs 25 and 26 with respective holes 25A and 26A. The handle chassis also includes a spring abutment 27 and abutments 28. The handle chassis is made from a non-magnetic material, in this case a plastics material.

Secured to the handle chassis is a piece of magnetic material in the form of a plate 29. In this case plate 29 is made from sheet steel.

The door handle assembly also includes a pivot pin 30, a first spring 31, a second spring 32, a first lever 33, a second lever 34 and a magnet 35.

The first spring has a series of coils 36, a first arm 37 and a second arm 38.

The second spring 32 has a series of coils 39, a first arm 40 and a second arm 41.

The first lever 33 has a generally cylindrical portion 42 having a central hole 43. Projecting generally tangentially from the cylindrical portion 42 is an arm 44 having a first engagement surface 45, a second engagement surface 46 and an abutment 47.

The second lever 43 has a generally cylindrical portion 48 which has a central hole 49.

At one end of the generally cylindrical portion is a first arm 50 having an abutment surface 51, a recess 52, a spring abutment 53 and a spring abutment 56.

At an opposite end of the generally cylindrical portion 48 is a second arm 54 with an abutment 55.

The magnet 35 is generally cylindrical.

The pivot pin 30 is mounted in holes 25A and 26A. The first lever is mounted on pivot pin 30 via central hole 43 and the second lever 34 is mounted on pivot pin 30 via central hole 49. The first lever 33 and second lever 34 can therefore rotate relative to pivot pin 30 as will be further described below.

The coils 39 of the second spring 32 are mounted around the generally cylindrical portion 48 of the second lever 34.

The coils 36 of the first spring 31 are mounted around the generally cylindrical portion 48 of the second lever 34.

The first arm 37 of the first spring 31 engages the second engagement surface 46 of the first lever 33. The second arm 38 of the first spring 31 engages spring abutment 53 of the second lever 34. The first spring 31 therefore biases the first lever 33 anticlockwise when viewing FIG. 1B and it biases the second lever 34 clockwise when viewing FIG. 1A, such that abutment 47 of the first lever is in engagement with abutment 55 of the second lever 34 (see especially FIG. 1B).

First arm 40 of the second spring 32 engages the spring abutment 27 of the handle chassis 18. Second arm 41 of the second spring 32 engages spring abutment 56 of the second lever 34. The second spring 32 therefore biases the second lever 34 anticlockwise when viewing FIG. 1A.

Magnet 35 is positioned within recess 52 and abuts lip 57 of the first arm 50.

Operation of the door handle assembly is as follows:

As shown in FIGS. 1A, 1B, 1C and 9A, the door handle 12 is in a rest position. Abutment 47 is in engagement with abutment 55. The second spring 32 has biased the second lever 34 to the position shown in FIG. 1A and hence (via the first spring 31) has caused the first lever 33 to move to the FIG. 1B position. A stop (not shown) prevents the second lever 34 moving further anticlockwise than is shown in FIG. 1A.

Figure 1B:
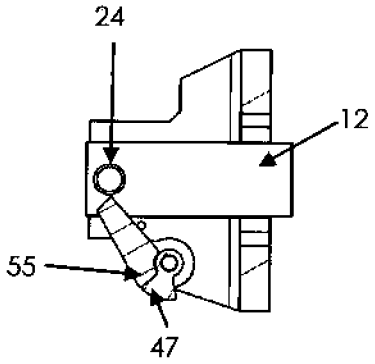

Note that magnet 35 is spaced from plate 29 as shown in FIG. 1A, and arm 44 is beneath pin 24 when viewing FIG. 1B, i.e. arm 44 will not be restrict movement of handle 12 and pin 24 in the direction of arrow X.

Figures 9A, 9B, 9C, 9D, 9E, 9F, 9G, 9H:
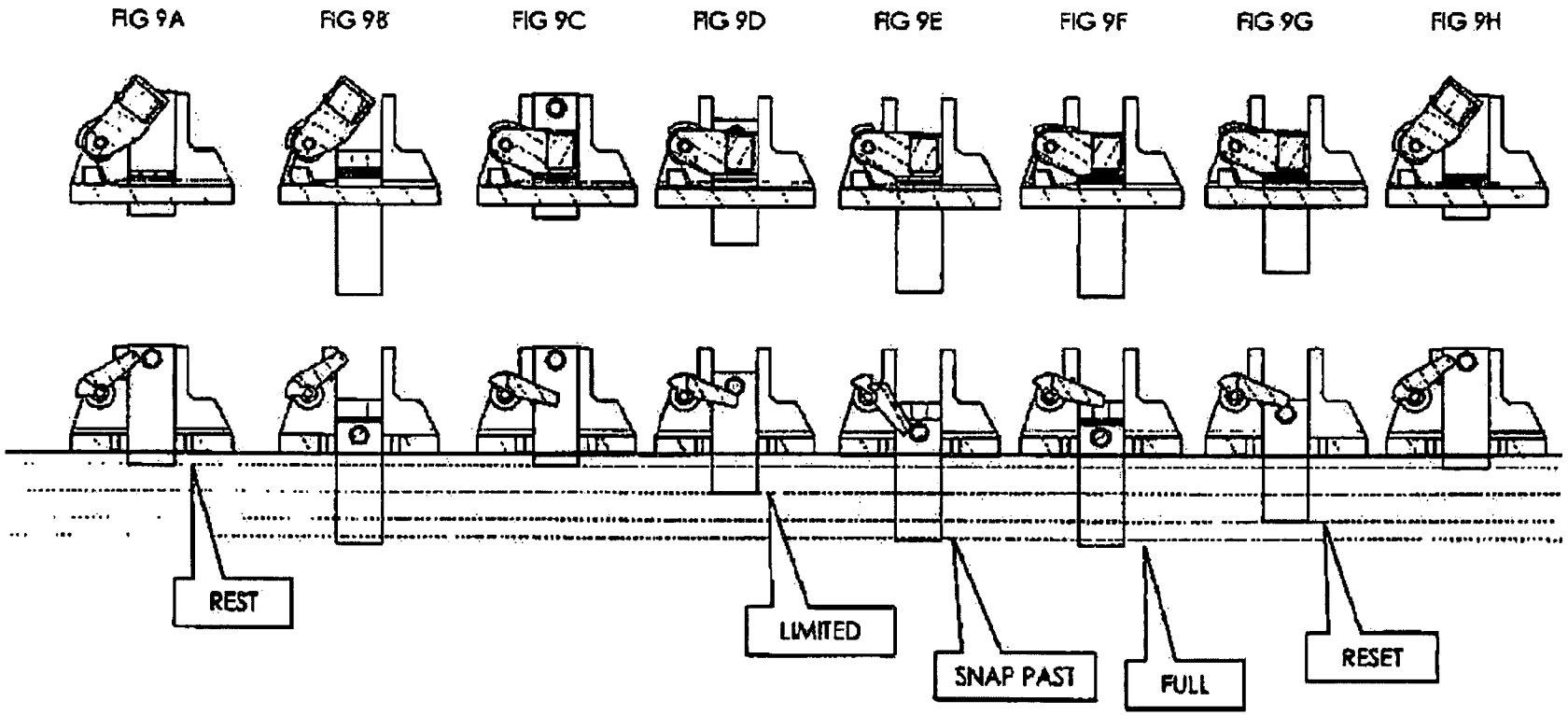

When it is desired to open the door, the door handle is moved in the direction of arrow X from the rest position as shown in FIG. 9A to the actuator position as shown in FIG. 9B. A comparison of FIGS. 9A and 9B show that the first spring 31, second spring 32, first lever 33 and second 34 are all in the same position. Once the door handle reaches the FIG. 9B position the movement of handle is transferred by the transmission path 80 to the latch 81 and the door opens as described above.

Once the door handle is released a handle return spring (not shown) will return handle from the FIG. 9B position to the FIG. 9A position.

Figure 2A:
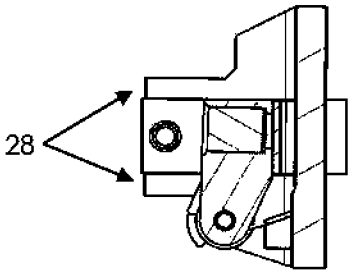
Figure 2B:
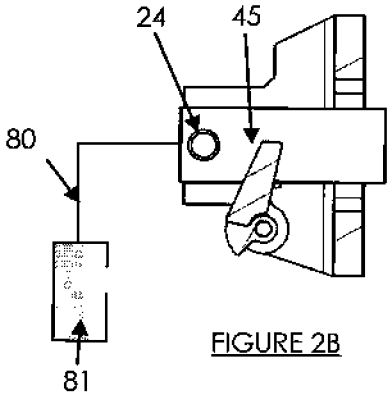

However, in the event of the vehicle being involved in an accident wherein a side impact occurs on door 11 in the direction of arrow Y a different sequence of events occurs which prevents the door opening. Thus:

Immediately following the initial impact the inertia of the arm 44, first arm 50 and magnet 35 cause the first lever 33 and second lever 34 to swing onto the FIGS. 2A, 2B and 9C position. Because the second spring 32 is a relatively light spring, the first lever 33, second lever 34 and magnet 35 are able to achieve the FIGS. 2A, 2B, 2C and 9C position before any significant movement of the door handle 12 has occurred. As is best seen in FIG. 2B, at this stage of the crash sequence the engagement surface 45 lies in the path of pin 24.

Figure 3A:
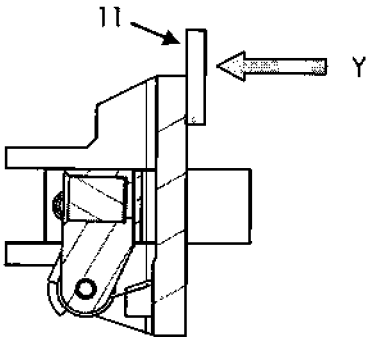
Figure 3B:
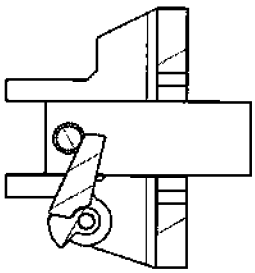
Figure 1C:
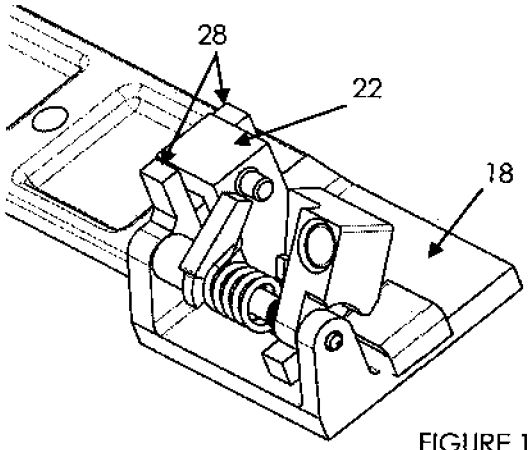
Figure 2C:
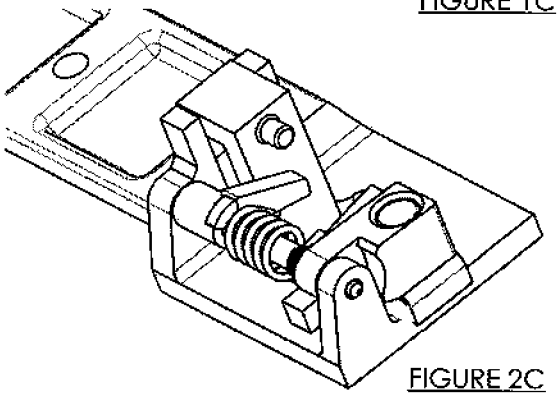
Figure 3C:
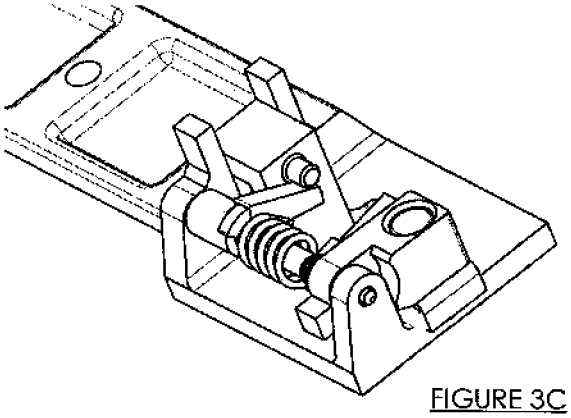

As the crash sequence continues, the inertia of door handle 12 causes it to move in the direction of arrow X towards its actuated position. However as shown in FIG. 3B, when the pin 24 engages the engagement surface 45 the inertia of the handle moving in the direction of arrow X is countered by the first spring 31 since the second arm 38 of the first spring 31 is abutting abutment 53 of the second lever and abutment surface 51 of the second lever is in engagement with plate 29 which, as mentioned above is secured to the handle chassis 18. As can be seen, first spring 31 is a relatively heavy spring and therefore can create a force greater than the inertia force of the handle. As the crash continues, the handle therefore cannot move past the FIGS. 3A, 3B, 3C and 9D position.

After the crash has occurred, and the vehicle is stationary, the handle return spring (discussed above) will return the handle 12 from the FIG. 3A position to the rest position (as shown in FIG. 1A). However, because the abutment surface 51 has engaged the plate 29 and the magnet 35 is very close to the plate 29, the relatively light second spring is unable to overcome the magnetic attraction between the magnet and the plate and hence both the first lever 33 and second lever 34 remain in the FIGS. 3A, 3B, 3C position.

Figure 4A:
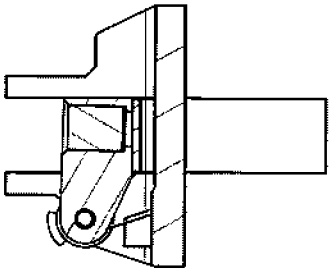
Figure 4B:
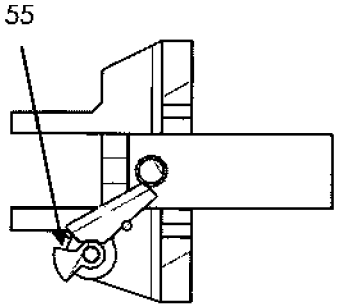
Figure 5A:
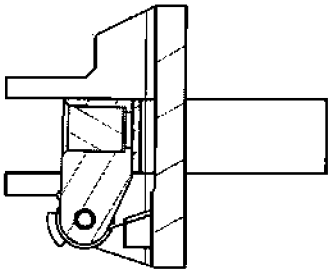

In order to subsequently open the door, the door handle 12 is pulled from its rest position through the FIG. 3A/B/C position, through the FIG. 4A/B/C position, through the FIG. 5A/B/C position to the FIG. 6A/B/C position whereupon the handle is in its fully actuated position and the latch releases as described above. As will be seen in the FIGS. 3B, 4B, 5B, 6B sequence of figures, as the pin moves in the direction of arrow X the first lever 33 moves clockwise as the force of the first spring 31 is overcome until such time as the pin 24 moves past the end of arm 44 whereupon arm 44 "snaps back" under the returning influence of the first spring 31. Note in particular, because the second lever 34 is restricted from moving further clockwise (as shown in FIGS. 3A, 4A, 5A and 6A the second lever has not moved) a gap appears between abutments 47 and 55 (see especially FIGS. 4B and 5B). Once the pin 24 has passed over the end of arm 44 the first lever 33 snaps back closing the gap as shown in FIG. 6B.

Figure 6A:
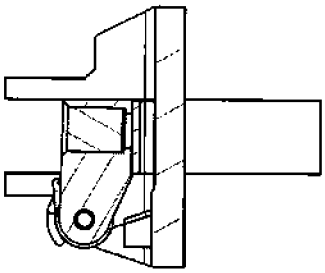
Figure 6B:
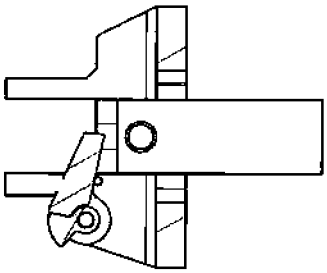
Figure 4C:
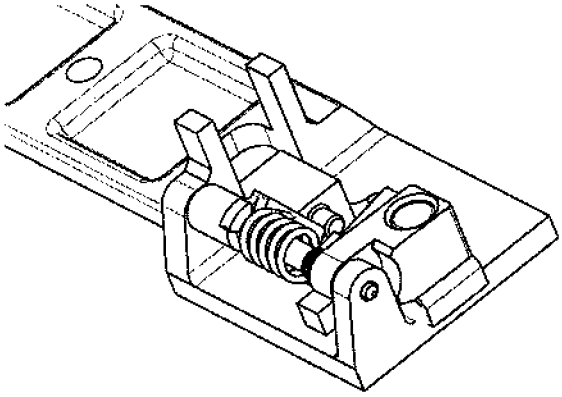
Figure 5C:
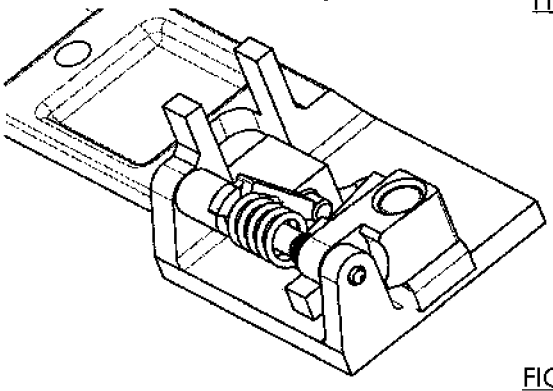
Figure 7A:
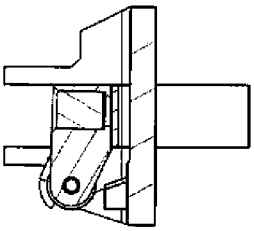
Figure 7B:
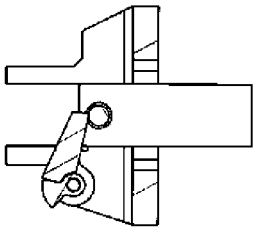
Figure 7C:
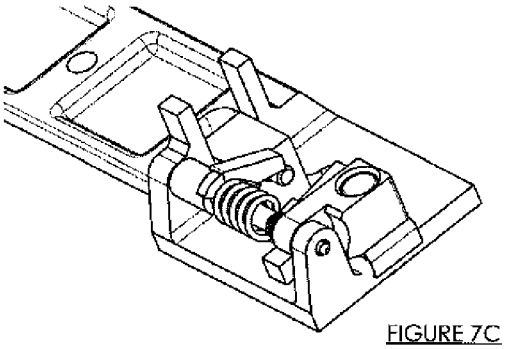

Once the door handle has been fully actuated (as shown in FIG. 6B) the handle is then returned to its rest position and in doing so the pin 24 engages the second engagement surface 46 causing the first lever 33 to rotate in an anticlockwise direction as shown in FIG. 7B. The abutment 47 then drives the abutment 55 and hence the second lever 34 in an anticlockwise direction to the rest position (compare and contrast FIG. 7A and FIG. 8A). Once the magnet has been moved sufficiently far away from the plate 29 the magnetic attraction between the magnet and the plate 29 will fall to a relatively low level, whereupon the force of the relatively light spring 32 will overcome the magnetic attraction and "snap" the device to the FIG. 8A/B/C position. As will be appreciated the spring 32 will obey Hook's Law, whereas the magnetic force between the magnet 35 and plate 29 is not proportional with the distance between these two components, rather as the magnet approaches the plate the magnetic force increase disproportionately. By way of example, at the FIG. 1A position the torque created by spring 32 tending to rotate the second lever anticlockwise is 12 Nmm, whereas in the FIG. 2A position it is 17 Nmm, i.e. it has only increased by 42%. However in the FIG. 1A position the magnetic force between the magnet and the plate creates a torque of less than 0.1 Nmm tending to rotate the second lever in a clockwise direction, whereas in the FIG. 2A position it creates a torque of 150 Nmm, i.e. an increase of over 1500%.

Figure 8A:
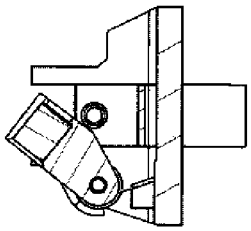

Continued movement of the door handle to the rest position will return the device from the FIG. 8A/B/C position to the FIG. 1A/B/C position. This opening and closing sequence is shown sequentially by FIGS. 9A, 9C, 9D, 9E, 9F, 9G and 9H.

Figure 15:
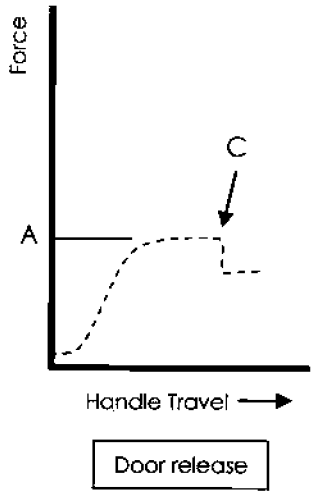

FIG. 15 shows a graph of the handle travel of door handle 10 versus the force required to pull the handle under normal opening conditions. The force required to pull the handle progressively increases up to a level A. Position C is the point at which the latch is released and a force required to pull the handle beyond this position suddenly drops.

Figure 16:
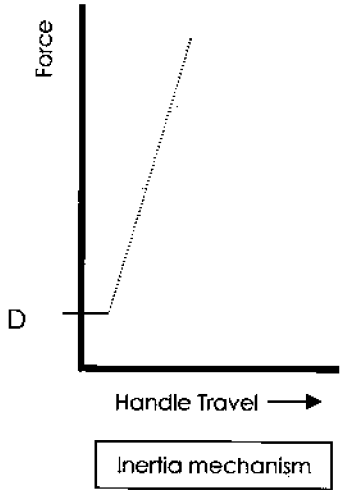

FIG. 16 shows the force generated by a first spring 31 assuming the engagement surface 45 is in the path of pin 24. Note that there is an initial handle travel where the spring fore is zero and this equates to the handle travel between the FIG. 2B position and FIG. 3B position. Once contact is made between pin 24 and engagement surface 45 at the FIG. 3B position the force immediately jumps to level D, and this is because spring 31 is pre-tensioned. It will be appreciated that the line shown on FIG. 16 is relatively steep.

FIG. 17 is a composite graph showing the graph of FIG. 15, the graph of FIG. 16 and the resultant handle load. The initial part of the graph E follows the FIG. 15 graph. At point F the components are in the FIG. 3B position and the graph immediately climbs to point G. Continued handle travel requires a force to overcome the normal opening force (FIG. 15) and also requires an additional force to overcome the force created by the first spring 31 (the FIG. 16 graph) and as such the graph climbs steeply to point H. Point H represents the FIG. 4B position where the first lever 33 is just about to snap back. As such the handle no longer has to overcome the force generated by the first spring 31 and the graph falls to the I position, i.e. the graph falls to the equivalent point on the FIG. 15 graph. From point I onto point C the graph is the same as FIG. 15.

FIG. 18 shows the composite line of FIG. 17 is isolation.

Consideration of FIG. 17 shows a force D which equates to the maximum likely inertia force of the handle 12 in an opening direction (arrow X) seen during a side impact crash. As will be appreciated, the design of the system is such that the minimum force required to open the door (B) once the engagement surface 45 has been positioned in the path of pin 24 is greater than force D. As such, during a crash the door handle will not reach its fully actuated position and the door will not open.

As described above, following the crash, when the vehicle has come to rest and the engagement surface 45 of the first lever 33 lies in the path of the pin 24, a subsequent manual operation of the door handle will open the door provided the force applied to the handle is at least force B.

Figure 6C:
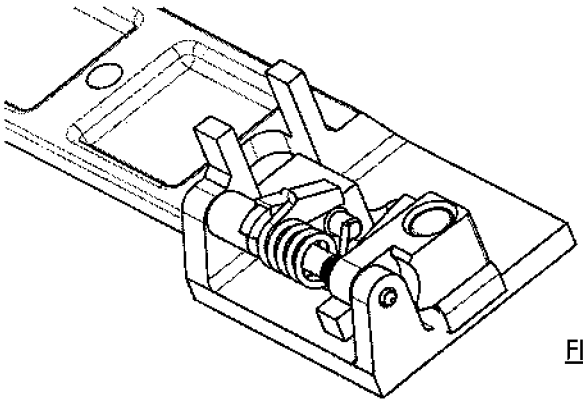

It will be appreciated that the door handle assembly 10 is a latch release system for releasing latch 81. The latch release system has a rest position (FIGS. 1A, 1B and 1C) and an actuated position (FIGS. 6A, 6B and 6C). The door handle assembly requires a first force (A) to move the handle from the rest position to the activated position. The door handle assembly also includes an inertia event sensor in the form of the first and second levers and the magnet. Door handle assembly also has a means for increasing the force required to operate the system (the first spring 31). Door handle assembly is arranged such that when the inertia event sensor detects an inertia event it activates the first spring 31 by causing the engagement surface 45 to lie in the path of pin 24. When so arranged the system requires a second force (B) higher than the first force (A) to move the handle to the actuated position.

As mentioned above, when positioned at the FIG. 5B position the first lever is at the point of snapping back. This results in a significant decrease in the force required to move the handle (see graph on FIG. 17 dropping from point H to point I). This sudden reduction in force puts lower stresses on the various components which can therefore be designed with lower forces in mind and hence can be lighter and/or made from cheaper materials and/or can be made using less material. As such the door handle assembly defines a latch release system which has an intermediate position (FIG. 5B) between the rest position (FIG. 1B) and the activated position (FIG. 6B). The latch release system requires the second force (B) to move the latch release system (handle) to the intermediate position. However after the intermediate position the latch release system (handle assembly) only requires a third force (A) which is lower than the second force (B) to move the system from the intermediate position to the actuated position.

FIGS. 10A to 14B show a second embodiment of a latch release system in the form of a door handle assembly 110 in which components which fulfil the same function as door handle assembly 10 are labelled 100 greater.

The handle strap 22 includes a steel plate 160. Significantly handle strap 22 does not include a pin equivalent to pin 24 of handle strap 22.

Figure 10A:
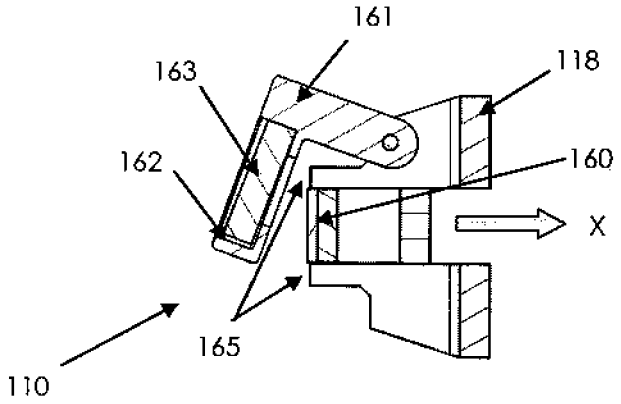

Lever 161 is pivotally mounted about pin 124 and is biased into the FIG. 10A position by spring 132. Lever 161 is generally L-shaped and includes a recess 162 which includes a magnet 163. Lips 164 are provided next to magnet 163. The handle chassis 118 includes abutments 165 which engage the lips as will be further described below.

Operation of the door handle assembly 110 is as follows:

During normal operation the rest position is as shown in FIGS. 10A, 10B, 14A and 14B. It will be appreciated that the magnet 163 is spaced from the plate 160 and the magnetic force of attraction between the magnet 163 and plate 160 is less than the spring bias force created by spring 132 biasing the lever 161 in an anticlockwise direction as shown in FIG. 10A.

Figure 13A:
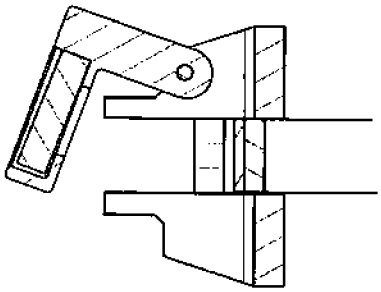
Figure 13B:
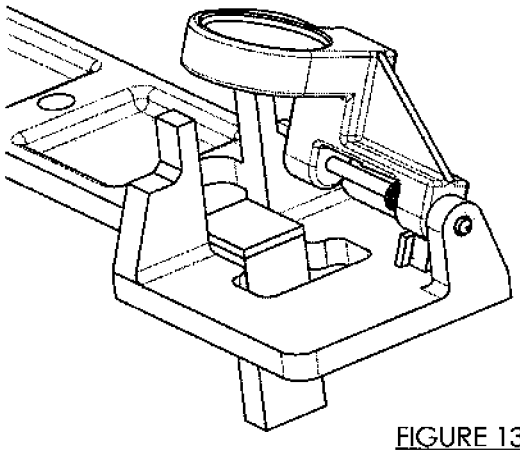
Figure 14A:
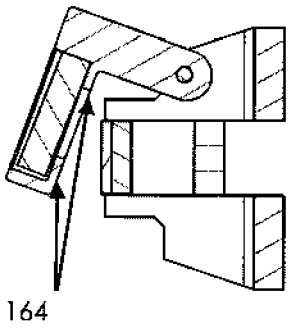
Figure 14B:
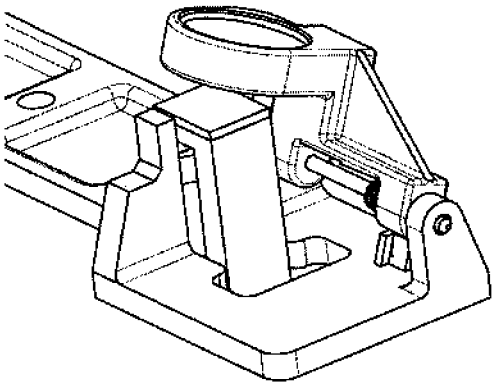

When it is required to open the door the door handle is pulled moving the handle strap in the direction of arrow X to the FIGS. 13A and 13B position, thereby opening the door. Once the door has been opened the handle is released and it returns under the action of a handle return spring (not shown) to the FIGS. 14A and 14B position (the same position as FIGS. 10A and 10B respectively). It will be appreciated that during the opening and closing sequence the lever 161 has not moved.

Figure 11A:
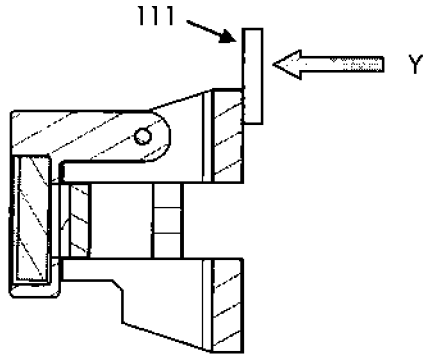
Figure 12A:
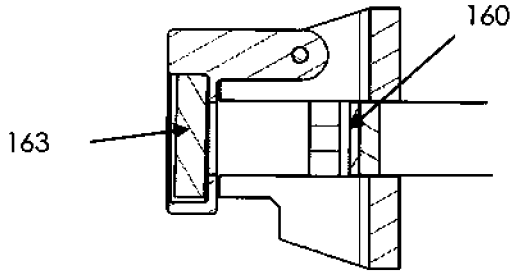
Figure 10B:
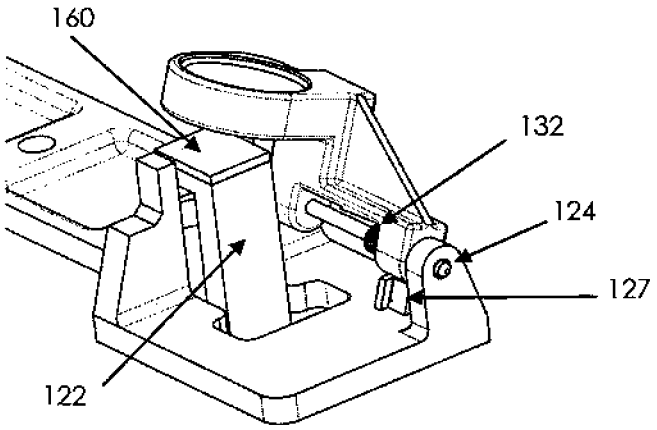
Figure 11B:
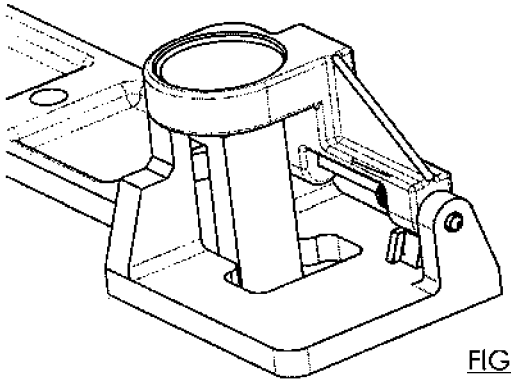
Figure 12B:
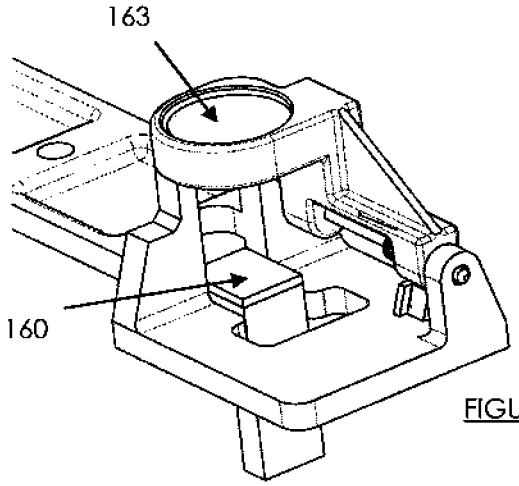

Operation of the device during and following a side impact is as follows:

When a side impact occurs on door 111 in the direction of arrow Y the mass of magnet 163 causes the lever 161 to overcome the spring bias of spring 132 and to swing to the FIGS. 11A and 11B position. At this position the magnet 163 is close to steel plate 160 and therefore the interaction between the magnet 163 and the steel plate 160 will hold the lever 161 in this position in spite of the return bias of the spring 132. As shown in FIG. 11A the lips 164 are abutting abutments 165. As the inertia force on the handle tending to move it in the direction of arrow X increases, this force is resisted by magnetic attraction between the magnet and plate 160. As such, throughout the crash sequence the handle will not move from its FIG. 11A position. Following the crash when the vehicle has come to rest, by applying a sufficient force (for example a force equivalent to force B) to the handle in the direction of arrow X the magnetic attraction between plate and the magnet can be overcome allowing the handle to move to the fully actuated position as shown in FIGS. 12A and 12B. Once in this position the latch releases the door and the door opens.

Furthermore, when the handle is in the FIG. 12A position the steel plate 160 is spaced from the magnet 163 and the magnetic attraction between the magnet and the plate is considerably reduced, indeed reduced to a level whereby the relatively light spring 132 can move the lever 161 back to the normal rest position. Once this occurs, the components are positioned as shown in FIG. 13A/13B. Once the door handle is released the handle return spring (as discussed above) will return the handle to the FIG. 14A/14B, FIG. 10A/FIG. 10B position.

It will be appreciated that during normal operation the force required to open the door is at a first level, typically force (A), whereas once the lever 161 has moved to the FIG. 11A position the force required to open the door is at a higher level (typically level B).

The door handle assembly 110 therefore provides a latch release system for releasing a latch, the latch release system having a rest position (FIGS. 10A, 10B, 14A, 14B) and an actuated position (FIGS. 13A and 13B) and requires a first force (typically A) to move the system from the rest position to the activated position, the system including an inertia event sensor (lever 161 and magnet 163) and a means (magnet 163 and plate 160) for increasing the force required to operate the door handle assembly, wherein when the inertia event sensor detects an inertia event it activates said means (by moving the magnet 163 close to plate 160) so that the door handle assembly requires a second force (typically B) higher than the first force to move the system to the actuated position.

The invention has been described in relation to outside door handles of vehicles. However, the invention is equally applicable to inside door handles of vehicles. Furthermore, the invention is equally applicable to the transmission path between either an outside door handle and the latch or an inside door handle and the latch. Furthermore, the invention is applicable to components within the latch. In other words, the latch release system of the present invention can be positioned in an outside door handle assembly, or an inside door handle assembly or in a transmission path between an outside door handle and a latch or in a transmission path between an inside door handle and a latch or in a latch.

As mentioned above, the magnet 35 together with plate 29 hold the inertia event sensor (i.e. the second lever 34) in the position shown in FIGS. 2B and 6B. In further embodiments an alternative means could be used for holding the inertia even sensor in this position. One such means could be hook and loop fasteners such as Velcro™. Thus the magnet could be replaced by one of the hook side or the loop side of the hook and loop fastener and the plate 29 could be replaced by the other of the hook side or the loop side.

Figure 20A:
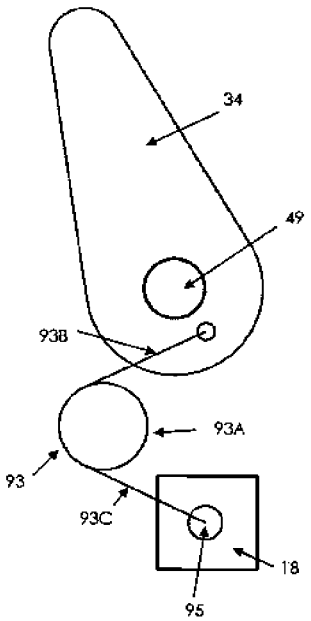
Figure 20B:
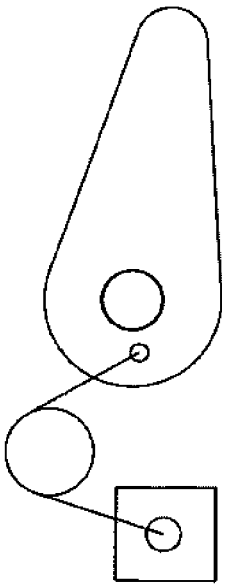
Figure 20C:
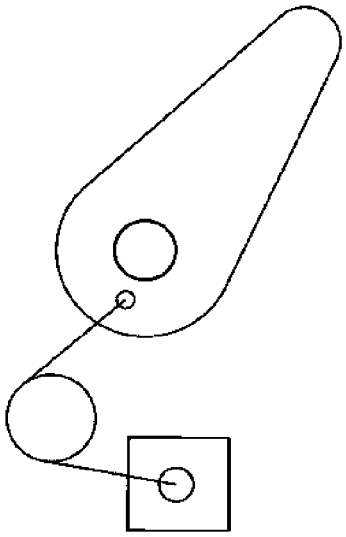

Alternatively a "bi-stable" spring arrangement could be used to hold the inertia event sensor in its activated position. Bi-stable spring arrangements are well known in latches and are used to releasably hold a lever in one of two alternate positions. Such an arrangement could be used on the second lever 34 and the system would be arranged so that during a crash the inertia of the inertia event sensor would be sufficient to overcome the spring and allow the inertia event sensor to move from its deactivated position (as shown in FIG. 1B) to its activated position (as shown in FIG. 2B). Thus FIGS. 20A to 20C show a variant 34' of the second lever 34 viewed in the same direction as FIG. 1A. As can be seen, the magnet 35 has been deleted. The second lever 34 is pivotally mounted upon a pivot pin via hole 49'.

A coil spring 93 has a series of coils 93A (only one of which is shown), a first arm 93B and a second arm 93C. The end of first arm 93B is engaged in a hole 94 in the second lever 34'. A second arm 93C engages a hole 95 in chassis 18 (drawn schematically). The spring is arranged such that the ends of arms 93B and 93C are biased away from each other. As the second lever moves from the 20A position (equivalent to the FIG. 1A position), through the FIG. 20B position to the FIG. 20C position (equivalent to the FIG. 3A position), the ends of arms 93B and 93C initially move towards each other (see FIG. 20B) and then move away from each other (see FIG. 20C). As such not only does the spring 93 act to hold the second lever 34' in its actuated position as shown in FIG. 20C, it also acts to hold it in its deactivated position as shown in FIG. 20A. Thus in the FIG. 20A position the spring 93 acts to prevent the second lever 34' from rattling during normal use of the associated vehicle.

The spring 93 fulfils the function of magnet 35 and plate 29 when in the FIG. 20C position and it fulfils the function of second spring 32 when in the FIG. 20A position. As such, variants incorporating the arrangement shown in FIGS. 20A to 20C do not require plate 29, magnet 35 or spring 32.

FIGS. 21A to 21C show a variant 34" of the lever 34'. In this case the coil spring 93 has been replaced by a compression 96. The top 96A of the spring 96 engages either with a first cam surface 97A of lever 34" to hold it in its engaged position as shown in FIG. 21C, or alternatively the top of compression spring 96 engages with a second cam surface 97B to hold the lever 34" in its deactivated position as shown in FIG. 21A. It will be appreciated that as the system moves from the FIG. 21A position through the FIG. 21B position to the FIG. 21C position the spring 96 is compressed (FIG. 21B) and then expands (see FIG. 21C). Thus spring 96 holds the inertia block lever 16 in both the FIG. 21C position when the lever 34" is in its activated position and the spring 96 also holds the lever 34" in the deactivated position as shown in FIG. 21A. When in the FIG. 21A position spring 96 also stops the lever 34" from rattling during normal use of the associated vehicle.

Figure 8B:
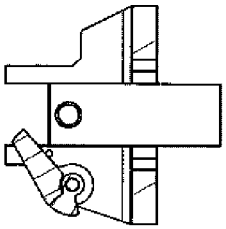
Figure 8C:
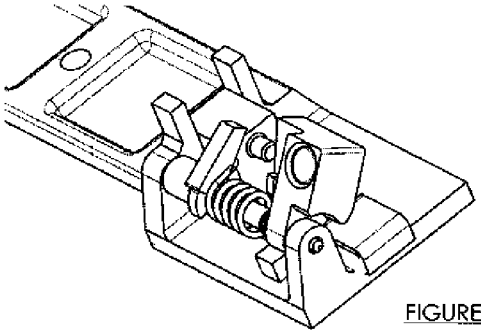

As mentioned above, by returning the handle from the FIG. 6B position to the FIG. 8B position the inertia event sensor is reset, i.e. it is moved to its deactivated position. In order to do this the force of attraction between the magnet and plate must be overcome. In one embodiment the strength of the handle return spring is sufficient alone to move the handle from the FIG. 6B position through the FIG. 7B position through the FIG. 8B position to the rest position as shown in FIG. 1B. However in further embodiments if the handle is simply released it may simply move to the FIG. 7B position and remain there until it is manually pushed to the FIG. 8B position, in order words the handle return spring may not have sufficient force to overcome the force of attraction between the magnet and the plate.

Figure 5B:
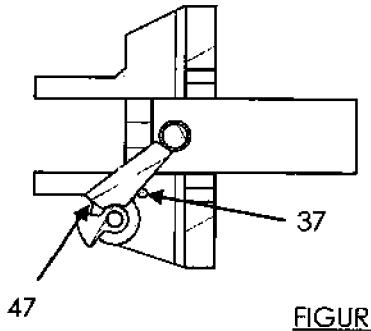

In a yet further embodiment, the inertia of the first lever 44 as it snaps back from the FIG. 5B to the FIG. 6B position may alone be sufficient to overcome the force of attraction between the magnet and the plate. In such an embodiment the first and second levers will move straight from the FIG. 6B position to the rest position as shown in FIG. 1B.

In the door handle assembly 10 the magnet is mounted on the second lever 34 and the plate is mounted on the chassis 18. In further embodiments the plate could be mounted on the second lever 34 and the magnet could be mounted on the handle chassis.

As mentioned above, various means are used to hold the second lever in its activated position, for example the combination of magnet 35 and plate 29, hook and loop fasteners, a bi-stable spring arrangement as shown in FIG. 20A or a cam arrangement as shown in FIG. 21A. All these arrangements have the advantage that they provide a force which resists movement of the second lever to the deactivated position. This "active" force makes it more likely that the inertia event sensor will function correctly even if there is a momentary change in direction of acceleration during an impact.

In particular with regard to magnet 35 and plate 29, the bi-stable spring arrangement shown in FIG. 20A and the cam arrangement shown in FIG. 21A, not only do these systems provide a force resisting movement of the second lever to the deactivated position, they actually provide a force biasing the second lever towards the activated position. This can be contrasted with a hook and loop fastener arrangement which does not provide for biasing the second lever towards the activated position, but nevertheless does provide an active force resisting movement of the second lever to the deactivated position. As such, these former systems actually engage more quickly because for example the magnet is always pulling the second lever towards the plate 29. Similarly, once the second lever passes the FIG. 20B position the spring 93 actively pushes it towards the FIG. 20C position. Similarly once the second lever 34" passes the FIG. 21B position the spring 96 actively pushes it towards the FIG. 21C position.

Certain aspects of the present invention utilise magnetic forces and/or magnets. Where such magnets are used in a latch assembly the magnets can attract small particles of steel within the latch. In particular such small particles of steel are creates during riveting processes typically associated with latches. As such, suitable precautions must be taken to ensure that these small pieces of steel do not affect the operation of the latch. However, the outside door handle assembly and the inside door handle assembly are likely to have several plastic components rather than steel components and/or several die cast components (typically die cast in a non-magnetic material). As such there is a lower likelihood of there being small magnetic particles in the outside handle assembly or the inside handle assembly and therefore precautions to protect against such particles may not be required. Similarly, when magnets are used in accordance with the present invention in the transmission path between the outside door handle and the latch, or in the transmission path between the inside door handle and the latch, then typically there is less likelihood of small magnetic particles and as such there is less likelihood of the need for taking precautions against such particles.

The invention claimed is:

1. A handle system for releasing a latch, the handle system including:

a handle that is movable between a rest position and an actuated position to release the latch and requiring application of an actuation force to move the handle from the rest position to the actuated position; and an inertia-activated device having an inactivated configuration and an activated configuration, such that when in the inactivated configuration the handle requires a first magnitude of the actuation force to move the handle from the rest position to the actuated position to release the latch, and when in the activated configuration the handle requires a second magnitude of the actuation force to move the handle from the rest position to the actuated position to release the latch, and wherein the second magnitude is greater than the first magnitude of the actuation force;

wherein the inertia-activated device is activated from the inactivated configuration by an inertia event and remains in the activated configuration after inertial forces of the inertia event are no longer acting on the inertia-activated device, and wherein said inertia-activated device comprises a magnet, and wherein the magnet is physically configured on the inertia-activated device to magnetically engage a complimentary magnetic structure, in response to inertial forces exerted on the inertia-activated device during the inertia event, to maintain the inertia-activated device in the activated configuration.

2. The handle system as defined in claim 1 in which the inertia-activated device includes a mass movable relative to the system.

3. The handle system as defined in claim 1 in which movement of the handle to the actuated position deactivates said inertia-activated device.

4. The handle system as defined in claim 1 in which movement of said handle to the rest position deactivates said inertia-activated device.

5. The handle system as defined in claim 1 in which the handle has an intermediate position between the rest position and the actuated position where the handle requires said second magnitude of the actuation force to move the handle to the intermediate position but requires a third magnitude of the actuation force, lower than said second magnitude of the actuation force, to move the handle from the intermediate position to the actuated position and movement of the handle past the intermediate position causes deactivation of said inertia-activated device.

6. The handle system as defined in claim 1 in which the handle system is in the &qui of an outside door handle assembly.

7. The handle system as defined in claim 1 in which the handle system is in the form of an inside door handle.

8. The handle system as defined in claim 1 in which the handle system is in the form of a latch assembly.

9. A handle system for releasing a latch, the handle system including:

a handle that is movable between a rest position and an actuated position to release the latch and requiring application of an actuation force to move the handle from the rest position to the actuated position; and an inertia-activated device having an inactivated configuration and an activated configuration, such that when in the inactivated configuration the handle requires a first magnitude of the actuation force to move the handle from the rest position to the actuated position to release the latch, and when in the activated configuration the handle requires a second magnitude of the actuation force to move the handle from the rest position to the actuated position to release the latch, and wherein the second magnitude is greater than the first magnitude of the actuation force;

wherein the inertia-activated device is activated from the inactivated configuration by an inertia event and remains in the activated configuration after inertial forces of the inertia event are no longer acting on the inertia-activated device, wherein the inertia-activated device includes a mass movable relative to the system, and wherein the handle has an intermediate position between the rest position and the actuated position where the handle requires said second magnitude of the actuation force to move the handle to the intermediate position but requires a third magnitude of the actuation force, lower than said second magnitude of the actuation force, to move the handle from the intermediate position to the actuated position.

10. The handle system as defined in claim 9 in which the handle system is in the form of an outside door handle assembly.

11. The handle system as defined in claim 9 in which the handle system is in the form of an inside door handle.

12. The handle system as defined in claim 9 in which the handle system is in the form of a latch assembly.

13. A handle system for releasing a latch, the handle system including:

a handle that is movable between a rest position and an actuated position to release the latch and requiring application of an actuation force to move the handle from the rest position to the actuated position; and an inertia-activated device having an inactivated configuration and an activated configuration, such that when in the inactivated configuration the handle requires a first magnitude of the actuation force to move the handle from the rest position to the actuated position to release the latch, and when in the activated configuration the handle requires a second magnitude of the actuation force to move the handle from the rest position to the actuated position to release the latch, and wherein the second magnitude is greater than the first magnitude of the actuation force;

wherein the inertia-activated device is activated from the inactivated configuration by an inertia event and remains in the activated configuration after inertial forces of the inertia event are no longer acting on the inertia-activated device, and wherein the handle has an intermediate position between the rest position and the actuated position where the handle requires said second magnitude of the actuation force to move the handle to the intermediate position but requires a third force, lower than second magnitude of the actuation force, to move the handle from the intermediate position to the actuated position in which movement of the handle from a position between the intermediate position and activated position to the rest position causes deactivation of the inertia-activated device.

14. The handle system as defined in claim 13 in which the handle system is in the form of an outside door handle assembly.

15. The handle system as defined in claim 13 in which the handle system is in the form of an inside door handle.

16. The handle system as defined in claim 13 in which the handle system is in the form of a latch assembly.

* * * * *